US007252221B1

(12) United States Patent
Bowers

(10) Patent No.: US 7,252,221 B1
(45) Date of Patent: Aug. 7, 2007

(54) MAILBOX DOOR RESTRAINT

(75) Inventor: John M. Bowers, Orlando, FL (US)

(73) Assignee: EuroAsia Products, Inc., Orlando, FL (US)

( * ) Notice: Subject to any disclaimer, the term of this patent is extended or adjusted under 35 U.S.C. 154(b) by 22 days.

(21) Appl. No.: 11/241,616

(22) Filed: Sep. 30, 2005

(51) Int. Cl.
*B65G 11/04* (2006.01)

(52) U.S. Cl. ..... 232/45; 232/17

(58) Field of Classification Search ..... 232/45, 232/44, 17, 38; D99/29–32, 43
See application file for complete search history.

(56) References Cited

U.S. PATENT DOCUMENTS

| | | | | | |
|---|---|---|---|---|---|
| 1,037,348 | A | | 9/1912 | Smith | |
| 1,136,505 | A | | 4/1915 | Razny | |
| 1,690,967 | A | | 11/1928 | Cobb | |
| 1,824,881 | A | | 9/1931 | Foss | |
| 2,169,855 | A | * | 8/1939 | Stough | 232/41 D |
| 2,437,053 | A | * | 3/1948 | Swanson | 232/17 |
| 2,484,718 | A | * | 10/1949 | McCullar | 232/35 |
| 2,960,265 | A | * | 11/1960 | Simon | 232/25 |
| 3,208,668 | A | * | 9/1965 | Dickins, Sr. | 232/33 |
| 3,722,460 | A | | 3/1973 | James, Sr. | 116/132 |
| 3,733,026 | A | * | 5/1973 | Rowe et al. | 232/35 |
| 3,758,027 | A | * | 9/1973 | Morgan | 232/17 |
| 3,827,626 | A | | 8/1974 | Daigle | 232/17 |
| 3,874,583 | A | * | 4/1975 | Moll | 232/17 |
| 4,186,869 | A | | 2/1980 | Brown | 232/17 |
| 4,901,913 | A | | 2/1990 | Fischer | 232/17 |
| 4,905,892 | A | | 3/1990 | Fischer | 232/17 |
| 5,339,980 | A | | 8/1994 | Stutler | 220/571 |
| 5,921,117 | A | * | 7/1999 | Illguth | 70/159 |
| 6,234,388 | B1 | | 5/2001 | Taylor | 232/47 |
| 6,244,505 | B1 | | 6/2001 | Grimes et al. | 232/47 |
| 6,772,939 | B1 | | 8/2004 | Simpson | 232/38 |
| 2002/0059691 | A1 | | 5/2002 | Audisio | 16/374 |

* cited by examiner

*Primary Examiner*—William L. Miller
(74) *Attorney, Agent, or Firm*—Brian S. Steinberger; Law Offices of Brian S. Steinberger, P.A.

(57) ABSTRACT

Door stop and impact absorber bracket for restraining mailbox doors from opening beyond a selected swing radius. The bracket can fit underneath the mailbox behind an existing lower hanging lip. The door stop bracket is positioned such that it limits the door from swinging beyond a desired point (for example approximately 90 degrees) when the door is opened. The bracket can have an elongated rectangular planar central portion, with bent ends, together forming a generally C-shape. The bracket can have cushion pad to protect both the door, hinges other components and even the body of the mail box from being damaged from excessive vibrations when the door reaches the maximum opening point. The pad can also reduce objectionable impact noise effects that are created when a mailbox door accelerates in a free fall to a stop.

11 Claims, 11 Drawing Sheets

Fig.1
(Prior Art)
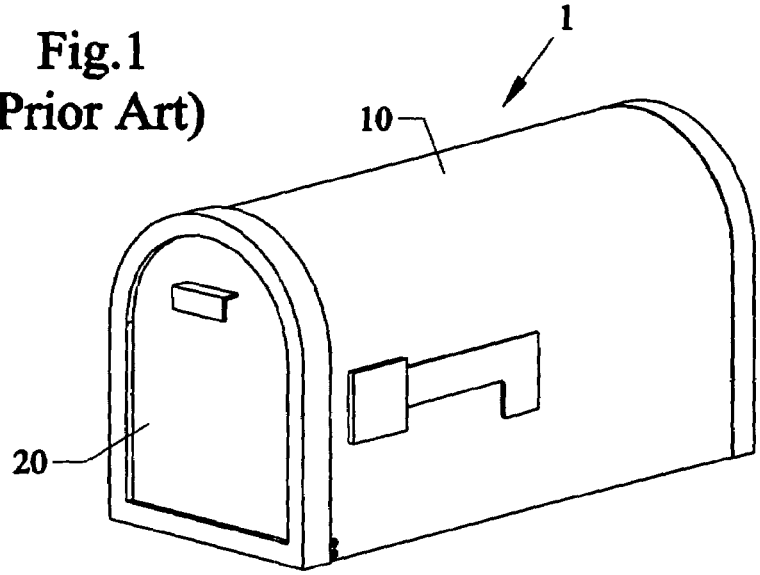
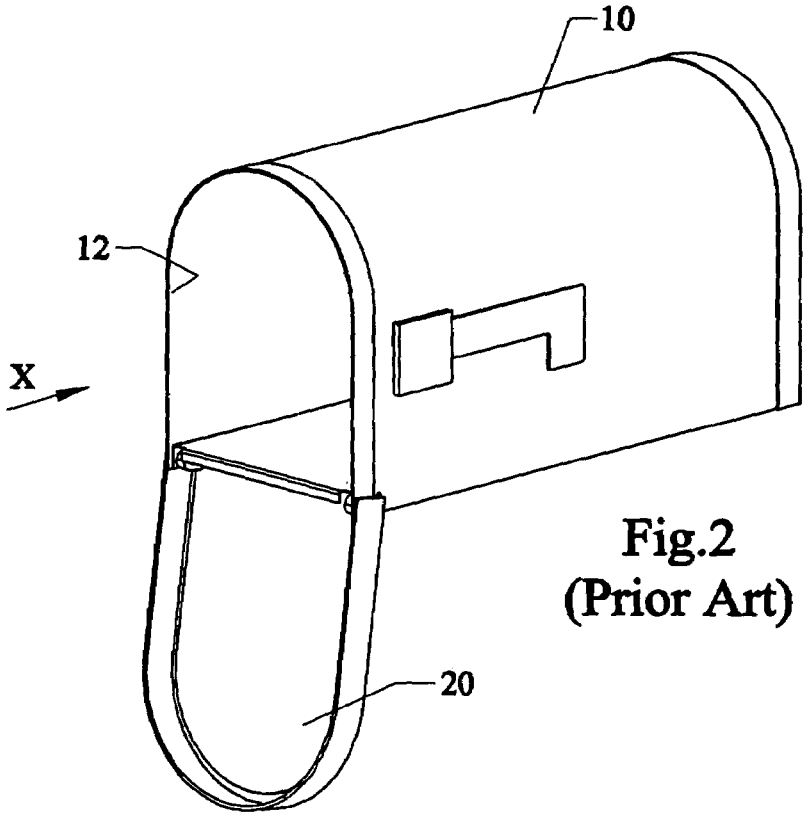
Fig.2
(Prior Art)

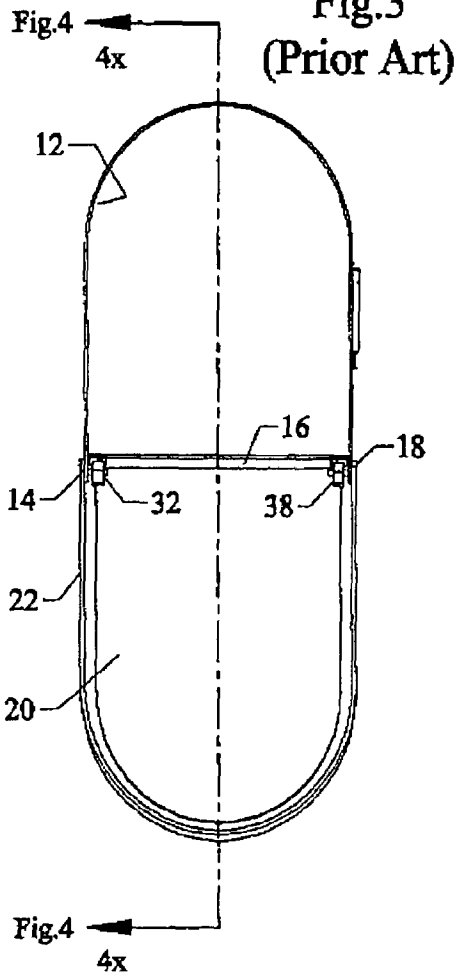
Fig.3
(Prior Art)
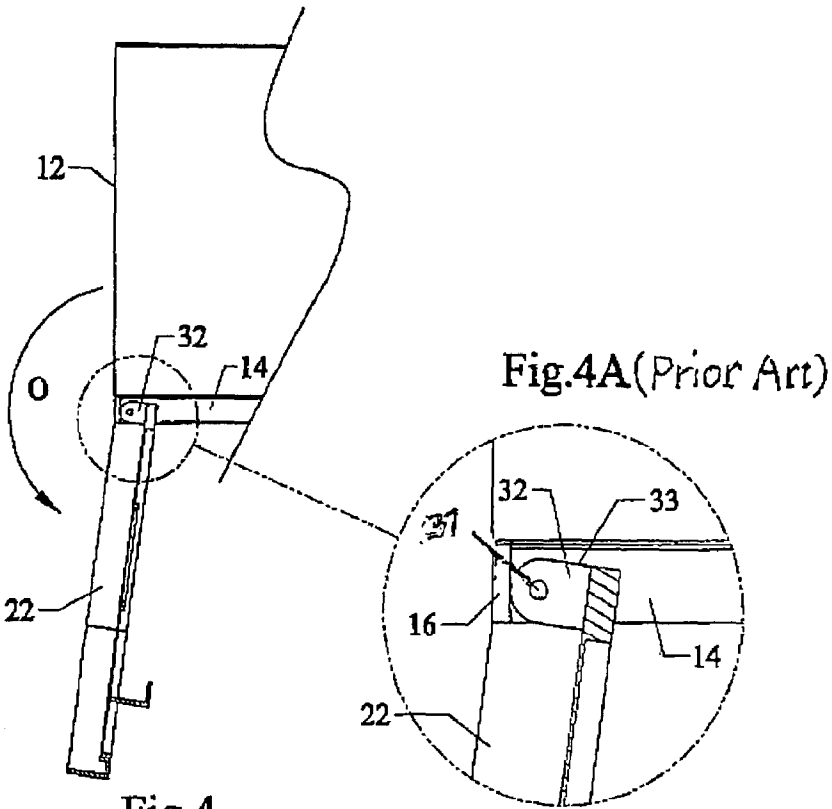
Fig.4
(Prior Art)
Fig.4A(Prior Art)

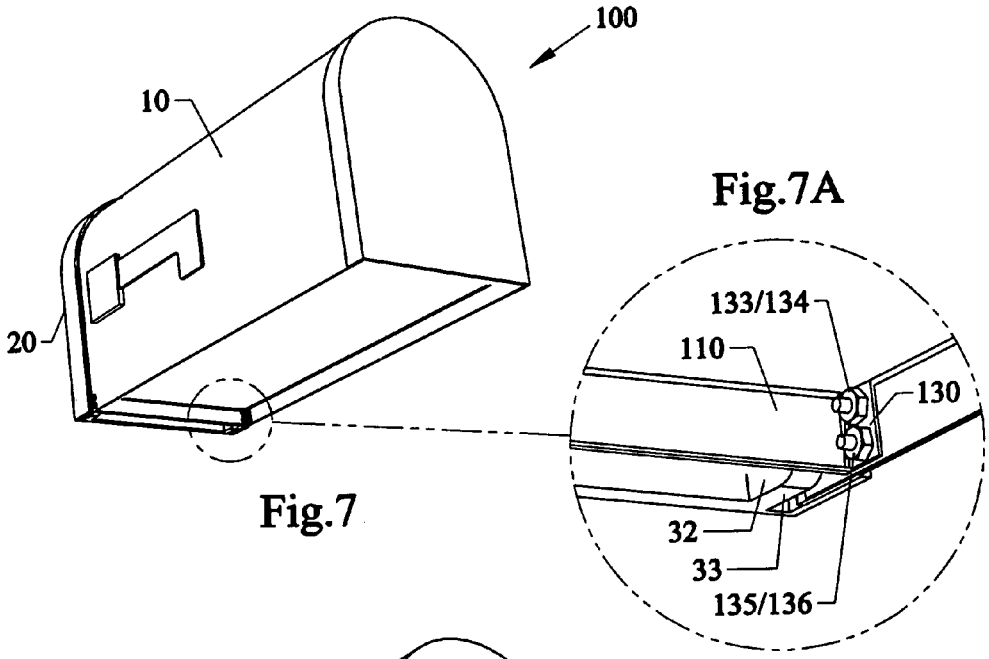
Fig.7A
Fig.7
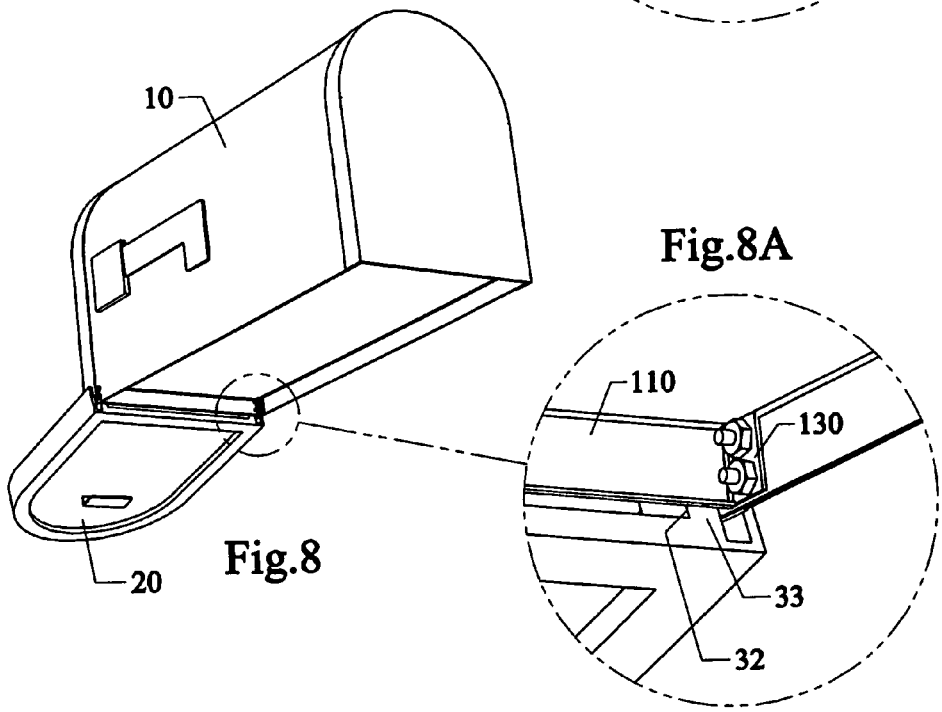
Fig.8A
Fig.8

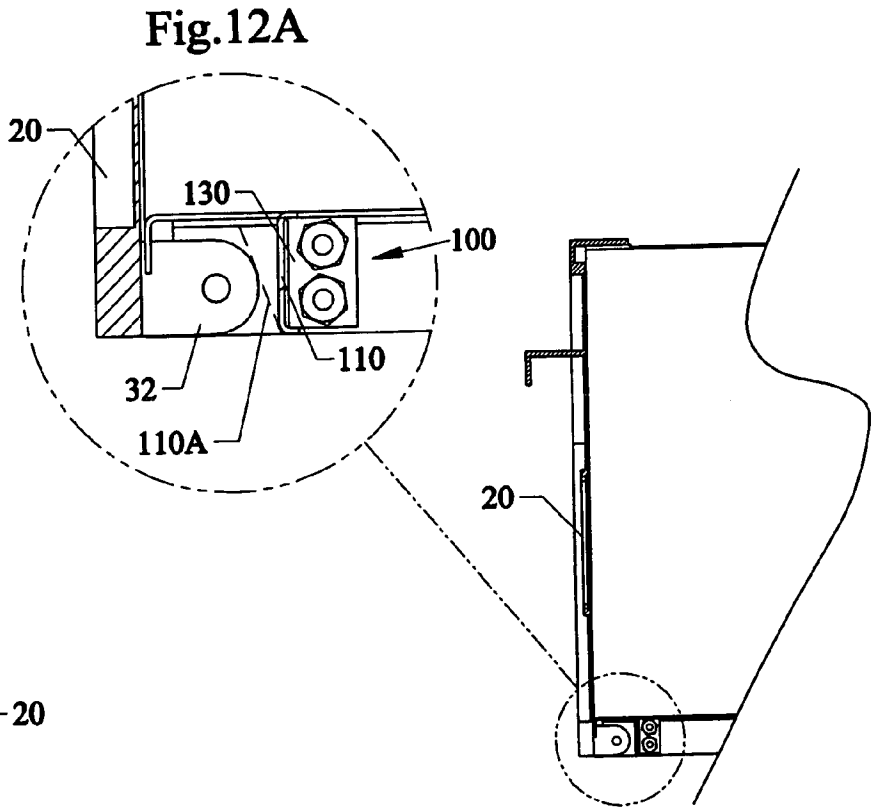
Fig.12A
Fig.12
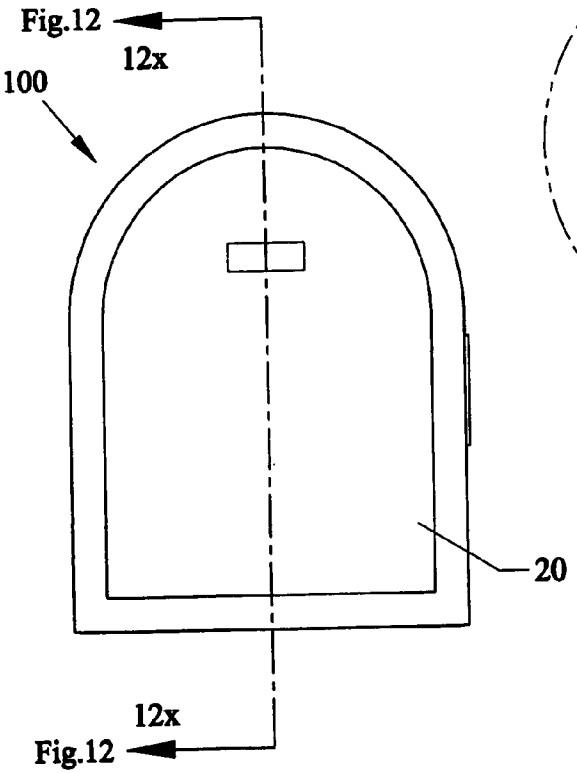
Fig.11

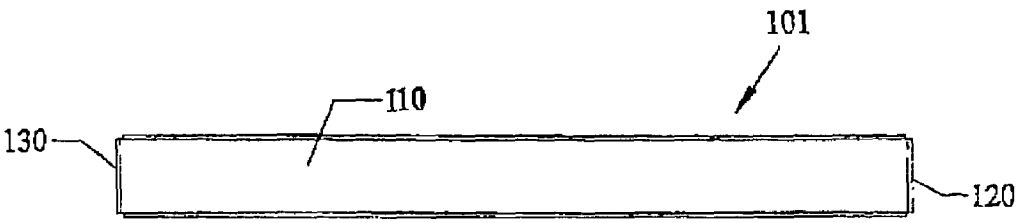
Fig.19
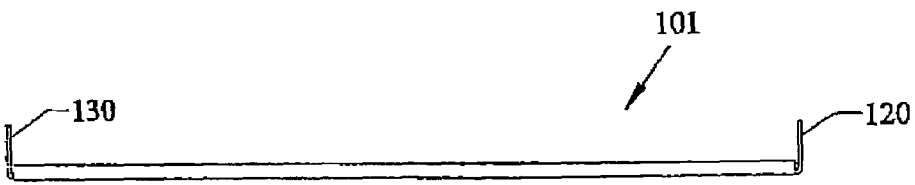
Fig.20
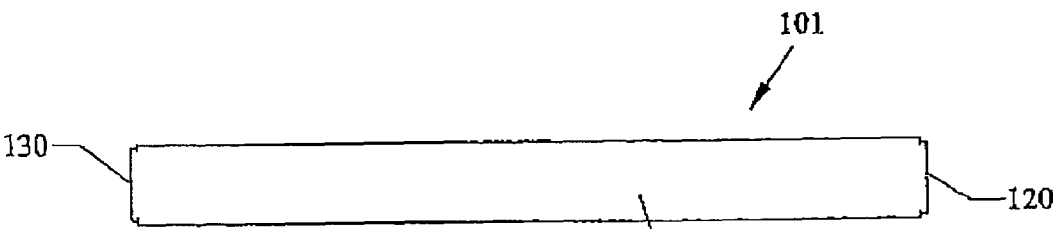
Fig.21
Fig.22
Fig.18

MAILBOX DOOR RESTRAINT

This invention relates to mailboxes, in particular to apparatus, devices and methods of restraining a mailbox door from opening beyond a selected swing radius.

BACKGROUND AND PRIOR ART

Mailboxes have been around for many years, and come in many sizes and shapes. The most popular mailboxes have an elongated compartment such as a rectangular housing with a flat roof or curved roof, and an access door that swings open based on a hinge mechanism the attaches the door to the lower front edge of the mailbox. However, mailbox doors tend to open much further than is needed. A typical mailbox door swings freely up to approximately 180 to approximately 270 degrees or more from a vertical upright closed position. The loosely swinging door has resulted in many problems.

For example, a mailbox door that hangs down is more prone to be twisted and bent overtime rendering the door useless from closing the mailbox. A downwardly hanging door can also break off from the mailbox leaving the interior of the mailbox continuously open. A constantly open mailbox can allow for any mail type contents inside to become damaged by being exposed to weather elements, and/or allow for the mailbox contents to become dislodged and lost, and even stolen overtime.

Additionally, a downwardly hanging bent and/or twisted mailbox door or portions of a door that remain can also be a snag hazard to others such as a mailman.

Still furthermore, most mailboxes being metal are prone to additional problems. These mailbox doors typically swing open so that metal eventually impacts metal that can cause damage to either or both the door, the handle, hinges, floor, other components and even the mailbox itself overtime. Metal hitting metal has also been known to cause objectionable loud impact noises that are created when a mailbox door accelerates in a free fall to a dead impact stop.

The constant banging between components can stress mailbox door hinges, other rotating points, welds and other assembly components causing parts to warp and/or loosen and/or fall off and/or become damaged overtime reducing the life of the mailbox.

The inventor is not aware of apparatus, devices and methods that overcome all the problems listed above. Thus, the need exists for solutions to the above problems with the prior art.

SUMMARY OF THE INVENTION

A primary objective of the present invention is to provide a restraint apparatus, device and method for limiting the swing opening radius of a mailbox door to stop at a generally horizontal orientation.

A secondary objective of the present invention is to provide a restraint apparatus, device and method for preventing a mailbox door from swinging to a position where the door hangs beneath the mailbox.

A third objective objective of the present invention is to provide a restraint apparatus, device and method for reducing the chances for the door to become twisted or bent overtime.

A fourth objective objective of the present invention is to provide a restraint apparatus, device and method for reducing the chances for the door and/or hinges and/or other components from becoming detached from the mailbox which reduces changes of mail type contents from becoming dislodged and lost, and stolen overtime.

A fifth objective of the present invention is to provide a restraint apparatus, device and method reducing the chances for the door to become a snag hazard to others.

A sixth objective of the present invention is to provide a restraint apparatus, device and method for reducing damage to both a mailbox door and the mailbox itself as the door is being swung open.

A seventh objective of the present invention is provide a restraint apparatus, device and method for reducing objectionable impact and collision noises and reducing vibration damage effects to both a mailbox door, other components and the mailbox itself as the door is being swung open.

An eighth objective of the present invention is to provide a restraint apparatus, device and method for extending the operational life of the mailbox.

The invention covers a mailbox door restraint apparatus, device and method that stop a freefall of a mailbox door being opened by reducing the amount of force as compared to a freefalling door with no restraint. The novel restraint reduces wear and tear on the door, rotational components and other mailbox assembly parts thereby increasing the operational life of the mailbox itself.

A preferred embodiment of the invention can be a mailbox having a chamber having at least one open end, a door pivotally attached to the open end of the chamber, and a restraint member for stopping the door from swinging open from a vertical position beyond a generally horizontal position.

The restraint member can include a bracket attached to both a lower front edge of the open end of the chamber, and to a lower edge of the door, the bracket having a portion which prevents the door from opening beyond the generally horizontal position. The bracket can have an elongated rectangular midportion and bent ends on opposite ends of the elongated rectangular midportion. The bent ends can include openings for allowing fasteners pass therethrough in order to fasten the bracket to the lower front edge of the open end of the chamber.

A pad can be attached to a face portion of the bracket and be used for dampening vibration and sound impact between the door and the bracket when the door reaches the generally horizontal position.

The restraint member can also include a lip portion which is attached to and hangs down beneath a lower front edge portion of the open end of the chamber behind a front lower hanging edge of the mailbox, wherein a portion of the door abuts against the lip portion which prevents the door from opening beyond the generally horizontal position.

The restraint can be a bumper portion attached to a lower portion of the chamber for preventing the door from opening beyond the generally horizontal position.

The invention can include a novel method of stopping a mailbox door from opening beyond a generally horizontal position, and can include steps of providing a mailbox having at least one open end, pivotally attaching a door to the open end of the mail box, and preventing the mailbox door from opening beyond a generally horizontal position.

The preventing step can include the step of attaching a lip portion to hang beneath the open end of the mailbox.

The preventing step can include the step of attaching a bracket having bent ends to a lower front edge of the open end of the mailbox.

The novel method can also include the step of cushioning impact between the door and the mailbox when the door opens to the generally horizontal position.

Further objects and advantages of this invention will be apparent from the following detailed description of the presently preferred embodiments which are illustrated schematically in the accompanying drawings.

BRIEF DESCRIPTION OF THE FIGURES

FIG. 1 is a perspective side view of a prior art mailbox.

FIG. 2 is another perspective view of the mailbox of FIG. 1 with the door open.

FIG. 3 is a front end view of the mailbox of FIG. 2 along arrow X.

FIG. 4 is a side cross-sectional view of FIG. 3 along arrows 4X.

FIG. 4A is an enlarged view of a portion of the door hinge of FIG. 4.

FIG. 7 is a perspective lower view of the mailbox with door closed of FIG. 5.

FIG. 7A is an enlarged view of a lower front portion of the mailbox of FIG. 7.

FIG. 8 is a perspective view of the mailbox with door open of FIG. 6.

FIG. 8A is an enlarged view of the lower front portion of the mailbox of FIG. 8.

FIG. 11 is a front end view of the closed door of the mailbox using the novel stop bracket.

FIG. 12 is a cross-sectional view of closed door mailbox of FIG. 11 along arrows 12X.

FIG. 12A is an enlarged view of the door hinge portion and stop bracket of FIG. 12.

FIG. 14A is an enlarged view of the door hinge portion and stop bracket of FIG. 14.

FIG. 18 is a left end view of the stop bracket of FIG. 17 along arrow 18X.

FIG. 19 is a top view of the stop bracket of FIG. 17 along arrow 19Y.

FIG. 20 is a front side view of the stop bracket of FIG. 17 along arrow 20X.

FIG. 21 is a bottom view of the stop bracket of FIG. 17 along arrow 21Y.

FIG. 22 is a right end view of the stop bracket of FIG. 17 along arrow 22X.

DESCRIPTION OF THE PREFERRED EMBODIMENTS

Figure 5:
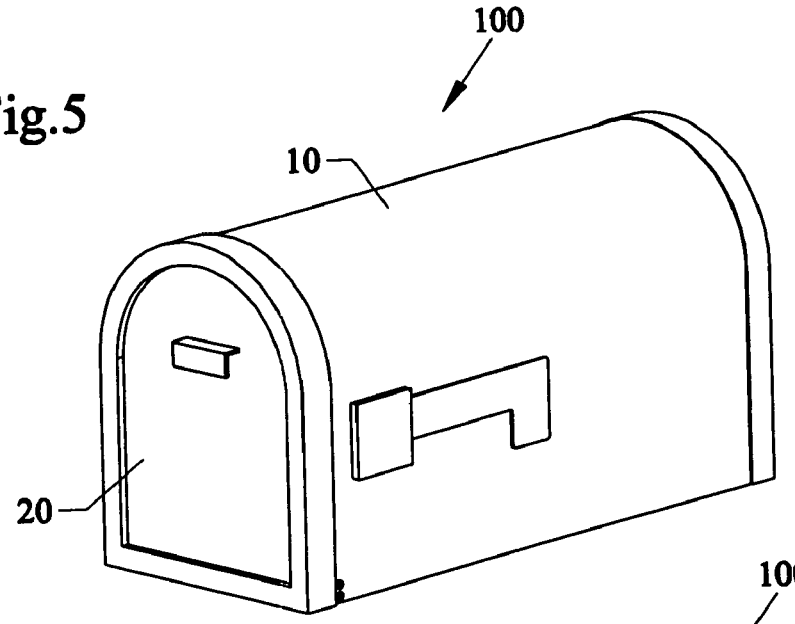
FIG. 5 is a perspective side view of a mailbox with door closed using the novel invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Prior Art Mailbox 1
Main chamber of mailbox 10
Open access end of mailbox 12
Existing lower hanging front edge of mailbox 16.
Existing floor of mailbox 15
Existing lower hanging side edges of mailbox 14, 18
Mailbox door 20
Inwardly bent side edges of door 22
Tab hinges pre-attached to door 32, 38
Rear edge portion of tab hinges 33, 39
Fasteners 37 attaching tab hinges to lower hanging side edges 14, 18 of mailbox
Invention Mailbox 100
Restraining Bracket 101
Rectangular Elongated Mid-portion 110
Angled Face of elongated mid-portion 110A
First bent end 120
Fastener mounting holes 121
Second bent end 130
Fastener mounting holes 131
Fasteners (screws/nuts) 133, 134 & 135, 136
Vibration and Sound absorbing and dampening pad 180
Elongated member 200
Bumper 300

FIG. 1 is a perspective side view of a prior art mailbox 1. FIG. 2 is another perspective view of the mailbox 1 of FIG. 1 with the door 20 being opened exposing an open access end 12 for the mailbox. FIG. 3 is a front end view of the mailbox 1 of FIG. 2 along arrow X. FIG. 4 is a side cross-sectional view of FIG. 3 along arrows 4X. FIG. 4A is an enlarged view of a portion of the door hinge 32 of FIG. 4.

Referring to FIGS. 1-4A, a typical mailbox 1 can include a main chamber having an open access end 12. Across a bottom floor 15 of the mailbox 1 can be lower hanging side edges 14, 18, and an existing lower hanging front edge 16. A mailbox door 20 can include inwardly bent side edges 22 which help seal the door 20 over the open end 12 when the door 20 is in a closed position. Pre-attached to lower corner edges of the door 20 can be tab type hinges 32, 38 which extend perpendicular in from a planar face of the door 20. Fasteners such as rivets 37 can attach the tab hinges 32, 38 into front portions of the lower hanging mailbox side edges 14, 18 behind the lower hanging mailbox front edge 16 in order to allow the door 20 to pivot relative to the mailbox open end 12. As can be seen in FIGS. 4 and 4A, the tab hinges 32, 38 allow the door 20 to move up to approximately 180 degrees or more from an initial closed position shown in FIG. 1.

Figure 6:
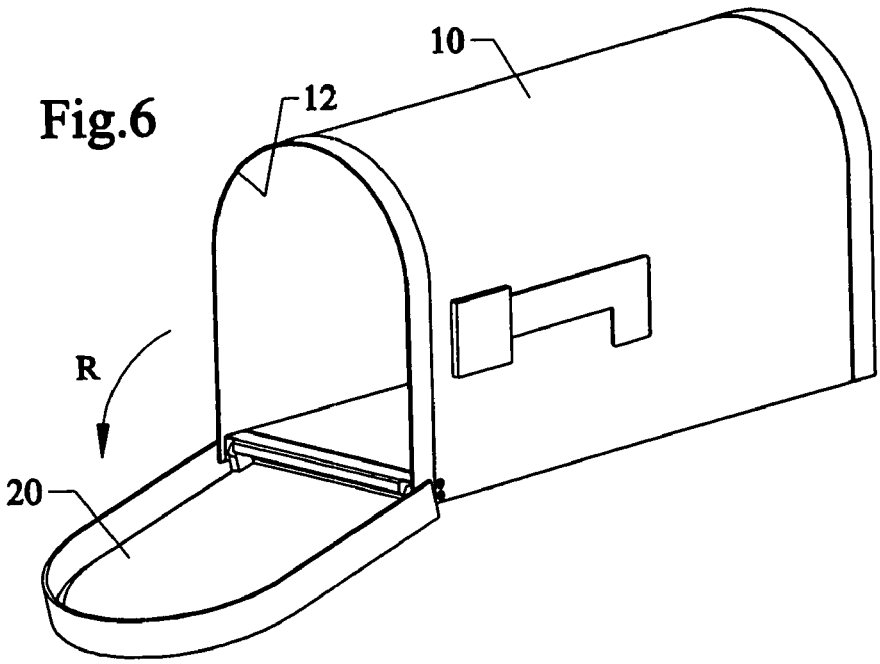
FIG. 6 is another perspective view of the mailbox of FIG. 5 with the door open.

FIG. 5 is a perspective side view 100 of a mailbox 10 with door 20 closed using the novel invention. FIG. 6 is another perspective view of the mailbox 10 of FIG. 5 with the door 20 opened along arrow R to no more than approximately 90 degrees from the access end 12 of the mailbox 100. As can be readily seen, the novel invention does not change the general outside appearance of prior art mailboxes previously described.

FIG. 7 is a perspective lower view of the mailbox 100 with door 20 closed of FIG. 5. FIG. 7A is an enlarged view of a lower front portion of the mailbox 100 of FIG. 7 showing the rectangular mid portion 110 and fastened bent end 130 of the novel restraining bracket 101 with the tab hinge 32.

FIG. 8 is a perspective view of the mailbox 100 with door 20 open of FIG. 6. FIG. 8A is an enlarged view of the lower front portion of the mailbox 100 of FIG. 8 showing the tab hinge 32 on the door 20 rotated to an open position where a rear edge portion 33 now abuts against the rectangular mid portion 110 of the novel restraining bracket 101.

Figure 9:
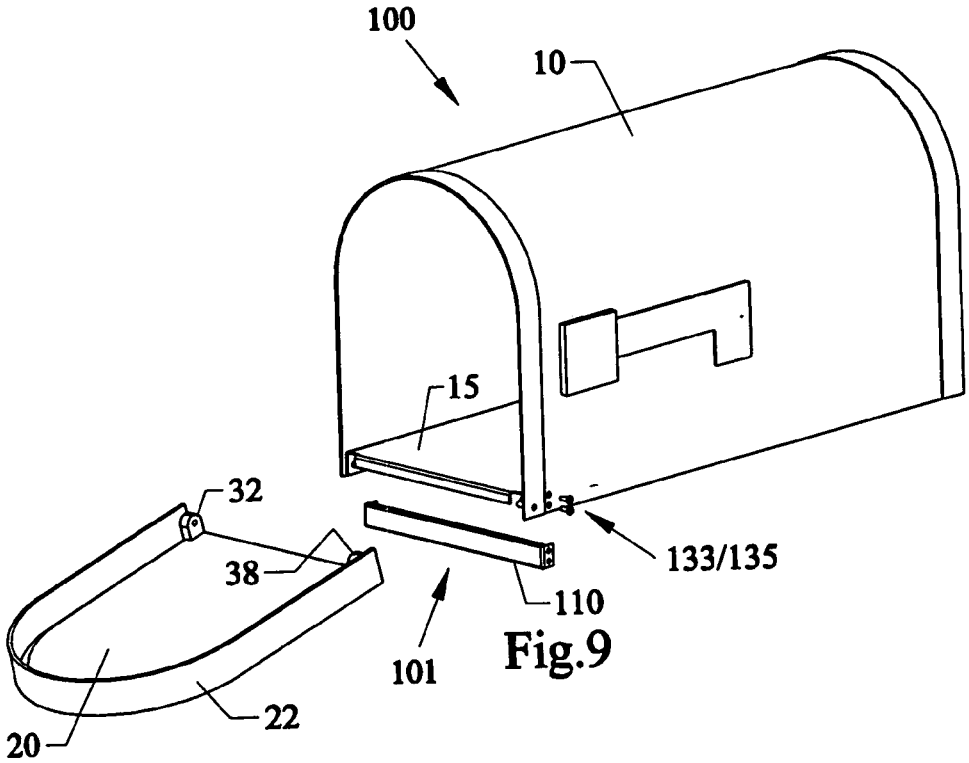
FIG. 9 is an exploded perspective side view of the mailbox, door and stop bracket.
Figure 10:
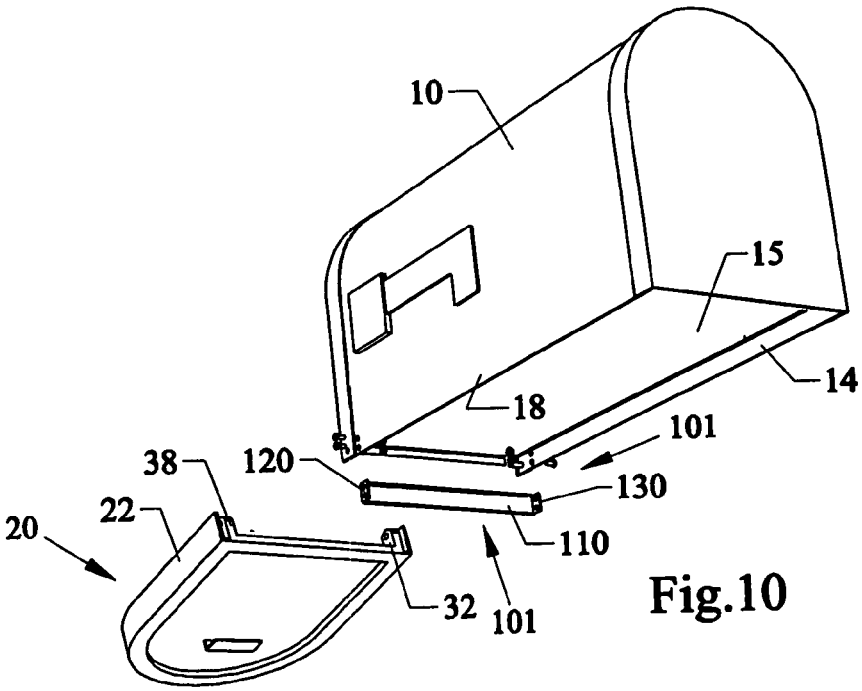
FIG. 10 is an exploded view underneath the mailbox, door, and stop bracket of FIG. 9.

FIG. 9 is an exploded perspective side view of the main chamber 10 of mailbox 100, door 10 and stop bracket 101, and fasteners 133, 135. FIG. 10 is an exploded view under the main chamber 10 of the mailbox 100, door 20, and stop bracket 101 of FIG. 9.

FIG. 11 is a front end view of the closed door 20 of the mailbox 100 using the novel stop bracket. FIG. 12 is a cross-sectional view of closed door mailbox 100 of FIG. 11 along arrows 12X showing the tab hinge 32 of the door 20 and stop bracket 101. FIG. 12A is an enlarged view of the door hinge portion of the tab hinge 32 and door 20 and stop bracket 101 of FIG. 12.

Figure 14:
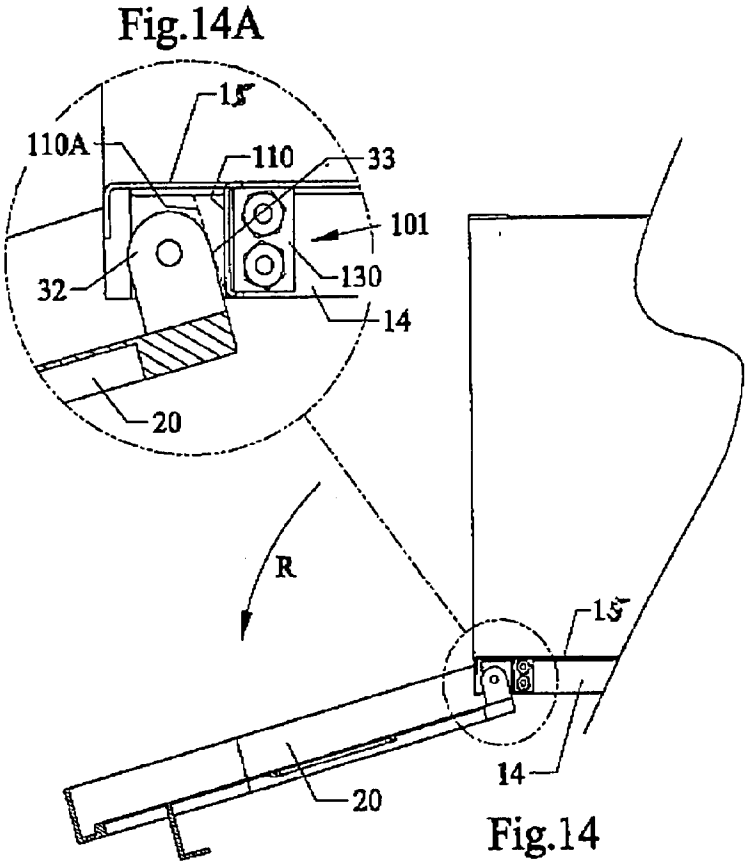
FIG. 14 is a cross-sectional view of the open door mailbox of FIG. 13 along arrows 14X.
Figure 13:
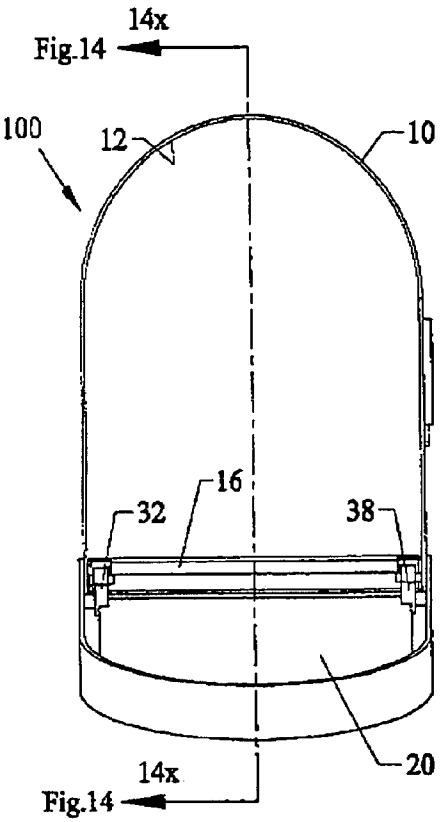
FIG. 13 is a front end view of the mailbox with an open door using the novel stop bracket.

FIG. 13 is a front end view of the mailbox 100 with an open door 20 using the novel stop bracket 101 which is positioned behind the existing lower hanging front edge of the mailbox floor 15. FIG. 14 is a cross-sectional view of the open door 20 of the mailbox 100 of FIG. 13 along arrows 14X. FIG. 14A is an enlarged view of the door hinge portion showing the tab hinge 32 on the door 20 rotated along arrow R to an open position where the rear edge 33 abuts against the front of the face of the rectangular mid portion 110 f the stop bracket 101 of FIG. 14.

Figure 17:
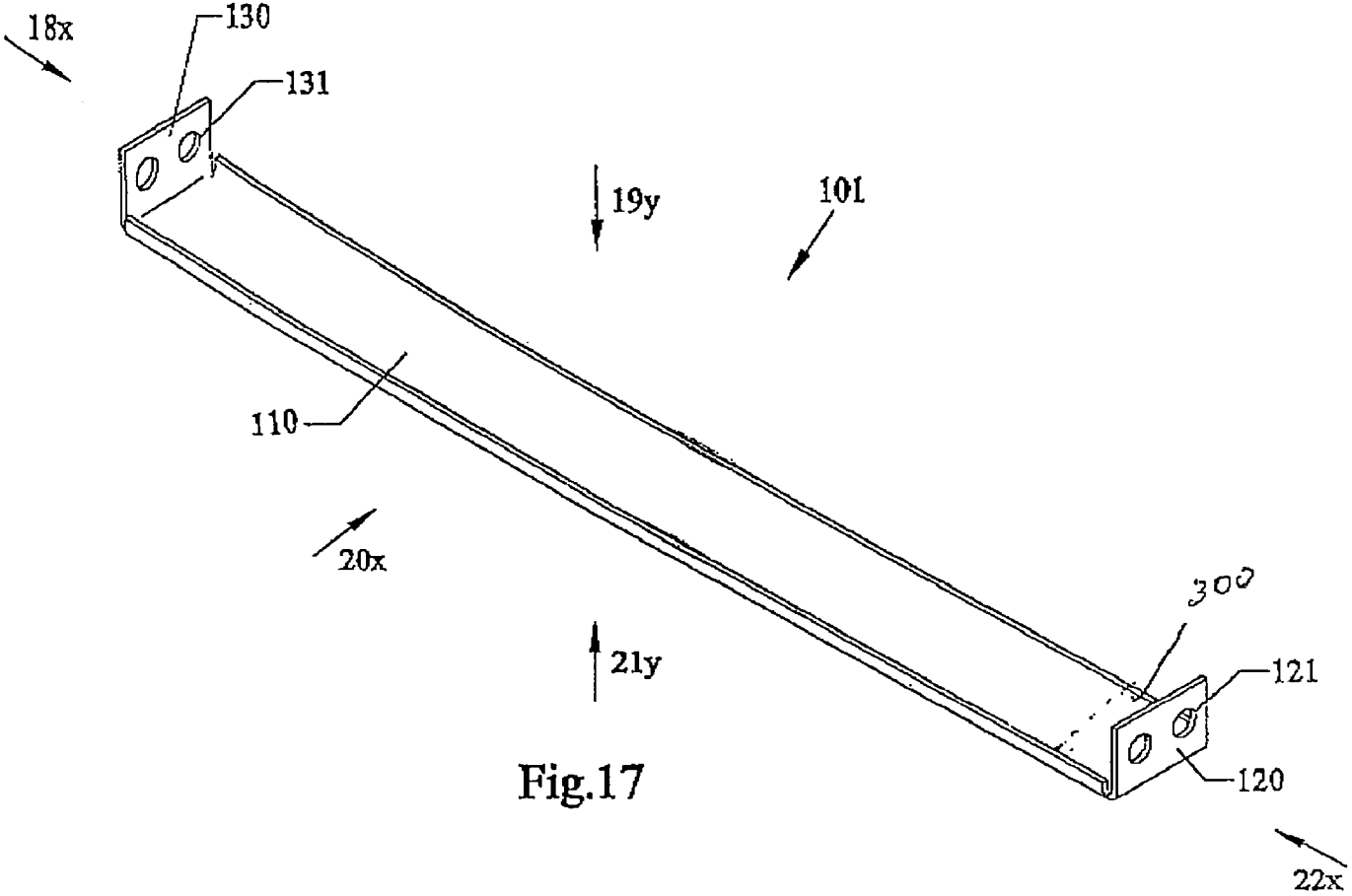
FIG. 17 is an upper perspective view of the novel stop bracket used in the invention.

FIG. 17 is an upper perspective view of the novel stop bracket 101 used in the invention depicted in the preceding figures showing the elongated rectangular mid portion 110, first bend end 120, with fastener mounting holes 121, and second bent end 130 with fastener mounting holes 131. FIG. 18 is a left end view of the stop bracket 101 of FIG. 17 along arrow 18X. FIG. 19 is a top view of the stop bracket 101 of FIG. 17 along arrow 19Y. FIG. 20 is a front side view of the stop bracket 101 of FIG. 17 along arrow 20X. FIG. 21 is a bottom view of the stop bracket 101 of FIG. 17 along arrow 21Y. FIG. 22 is a right end view of the stop bracket 101 of FIG. 17 along arrow 22X.

The operation of using the novel invention will now be described in reference to FIGS. 5-14 and 17-20. The novel stop restraining bracket 101 can be attached underneath the floor 15 of the main chamber 10 of the mailbox 100, behind the existing lower hanging front edge 16 of the mailbox and also slightly behind the door attached tab hinges 32, 38. The bent ends 120, 130 of the novel bracket 101 can be attached to existing lower hanging side edges 14, 18 which are on both sides of the mailbox floor 15. Fasteners 133, 134 & 135, 136 such as screws and nuts, rivets, welds, mechanical bends and interlocking types of slots and/or tabs, and the like, can fasten through openings 121, 131 in bent ends 120, 130 and into the lower hanging side edges 14, 18 below the mailbox floor 15.

When the door 20 of the mailbox is being opened, and pivots by way of tab hinges 32, 38, the door can move in the direction of arrow R until the rear edges 33, 39 of the tab hinges 32, 38 abut against front portions of the elongated rectangular mid portion 110 of the stop restraining bracket 101. The position of the elongated rectangular mid portion 110 prevents the tab hinges 32, 38 from opening the door 20 beyond an approximate 90 degree swing opening, which puts the door 20 approximately perpendicular to the open access end 12 of the main chamber 10 of the mailbox 100. A preferred application would allow for the door 20 to end up approximately horizontal, and in a similar plane to the floor 15 of the mailbox 100.

Figures 15, 16, 16A:
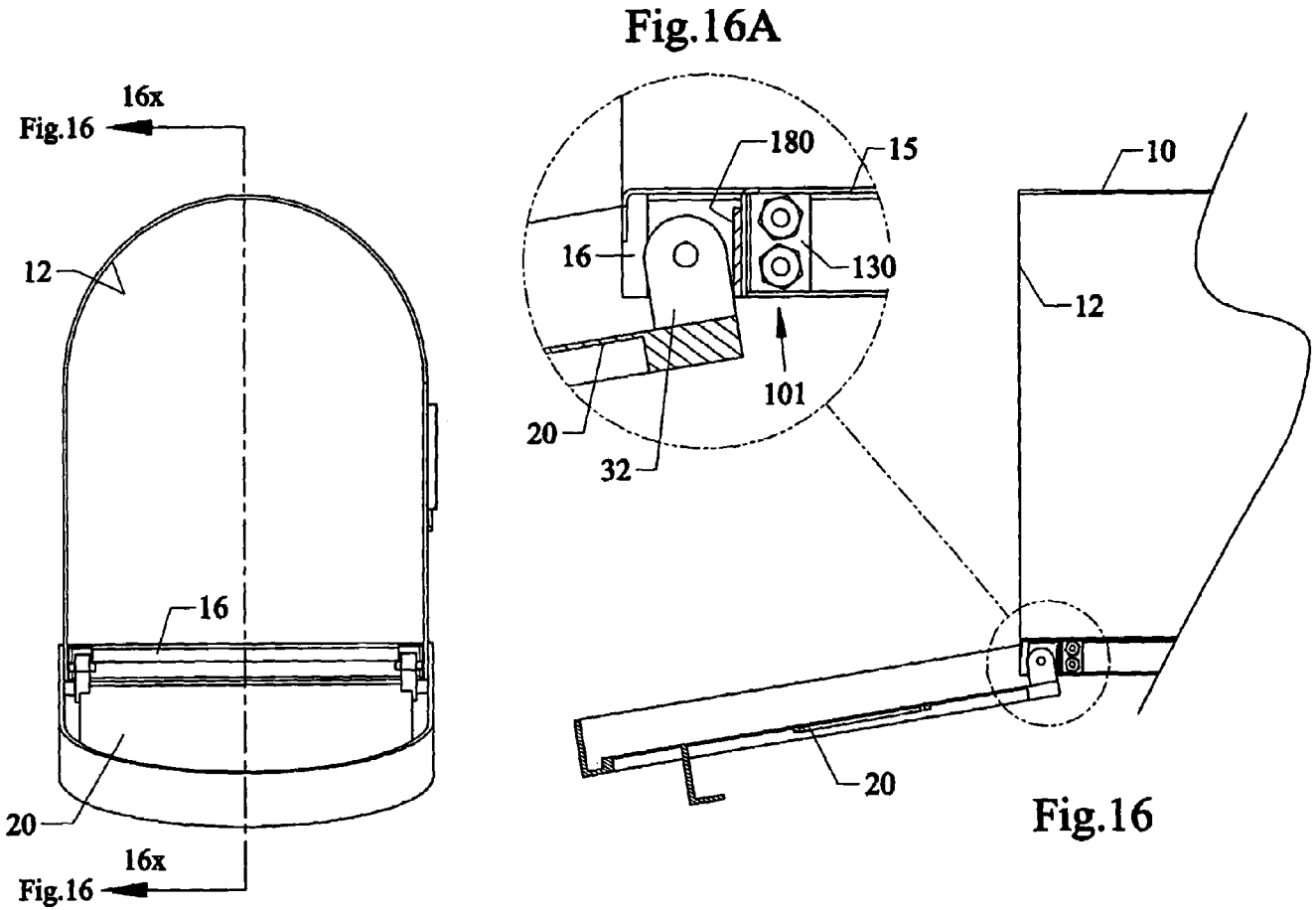
FIG. 15 is a front end view of the mailbox with open door using the stop bracket and pad.
FIG. 16 is a cross-sectional view of the door hinge, stop bracket and pad of FIG. 15.
FIG. 16A is an enlarged view of the door hinge, stop bracket and pad of FIG. 16.

FIG. 15 is a front end view of the mailbox with open door 20 using the stop bracket 101 and pad 180. FIG. 16 is a cross-sectional view of the door hinge portion of the tab hinge 32, stop bracket 101 and pad 180 of FIG. 15. FIG. 16A is an enlarged view of the door hinge tab hinge 32 and door 20, stop bracket 101 and pad 180 of FIG. 16. Here, a pad 180 such as a rubber material, plastic layered material, and the like can be positioned on a face portion of the elongated rectangular mid portion 110 of the stop restraining bracket 101. The pad 180 can function as a cushion to absorb any vibration which can occur when the door 20 is being opened and would dampen and/or reduce any noise effects that would have existed by tab hinges of the door banging against the restraining bracket 101. The pad would provide both sound and impact vibration dampening effects.

The bracket 101 can be set in place at different angles to encompass a greater or less impact surface contact points. The mid portion of the bracket face 110A can be angled (See FIGS. 12A, 14A) to provide a greater contact surface area and/or a more precise contact points when the tab hinges 32, 38 rotate back. Positioning the bracket 101 to different anglers can be used with different mailboxes and their doors.

Although the invention describes using the restraint bracket to limit the opening of the mailbox door 20 to up to approximately ninety degrees, the location of the novel restraining bracket can be moved to allow the door 20 to open up to less than or greater than a perpendicular orientation.

While the invention shows a bracket fastened in place by screw type fasteners, the restraint bracket can be attached in other ways. For example, the restraint bracket can be one member or plural members that are pre-stamped in place. For example, the restraint can be a lip edge that is bent downward. Alternatively, the restraint bracket can be welded in place. Alternatively, the restraint bracket can be riveted in place.

Figure 23:
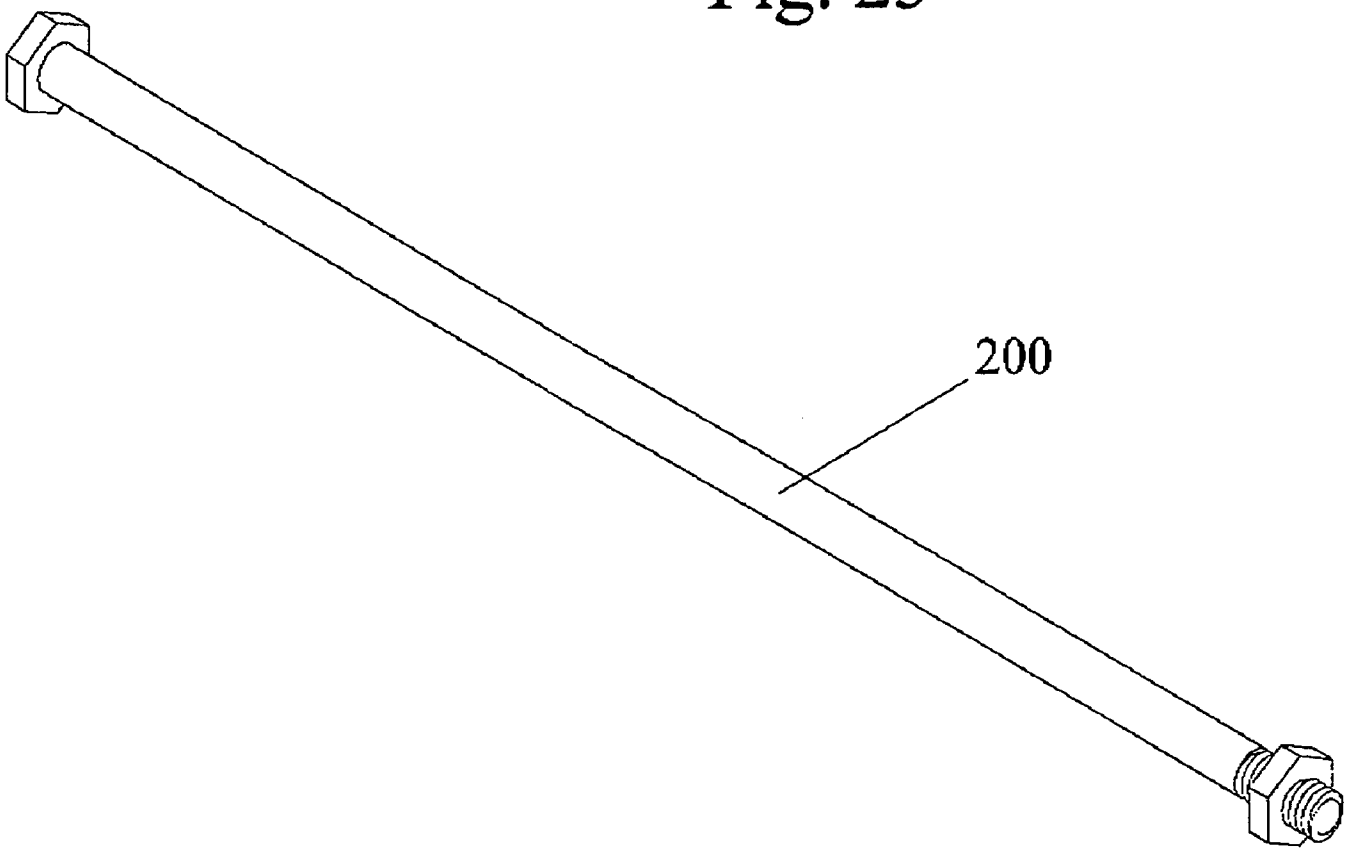
FIG. 23 is a view of the elongated member embodiment.

The invention is intended to cover alternative versions of the restraint bracket that can be used. For example, a single elongated bolt or bar 200 shown in FIG. 23 can pass through and be attached to both lower hanging side edges, where the bolt body surface functions as a stop to prevent the door from opening beyond a selected swing radius. The bolt can include a cylindrical sleeve and/or noncircular exterior shaped sleeve cover.

Although a preferred application is using an elongated bracket or elongated bar/bolt, the invention can use instead two separate bumper members each fastened to the downwardly hanging sides. Still furthermore, a single bumper (tab 300 shown in FIG. 17) can be used that is shaped to allow one of the tab hinges 32, 38 to abut against limiting the swing radius of the door. The single bumper can be a small block shaped member or tab 300 that can be connected similar to the bracket and bumpers described above, or fastened into one lower hanging side of the mailbox by screws, and the like.

The invention can be retrofitted into existing mailboxes and/or made to be part of newly manufactured mailboxes.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A mailbox for receiving mail, comprising:

a chamber having at least one open end with a front edge, and lower hanging side edges, wherein the lower hanging sides edges extend below a floor of the chamber;

a door pivotally attached to the open end of the chamber; and a bracket attached adjacent to and behind the front edge of the open end of the chamber such that the bracket is adjacent to a lower edge of the door, the bracket having an elongated midportion and bent edges on opposite ends of the elongated midportion, the bent edges having openings for allowing fasteners to pass therethrough in order to fasten the bracket to the lower hanging sides edges, wherein the bracket provides for limiting a swing opening radius of the door by a portion of the lower edge of the door abutting against a portion of the bracket.

2. The mailbox of claim 1, further comprising:

a pad positioned between the bracket and the door for providing a vibration and sound dampening impact between the door and the bracket when the door reaches the swing opening radius limit.

3. The mailbox of claim 1, further comprising:

a cushion positioned between the bracket and door for cushioning impact between the door and the bracket, when the door reaches the swing opening radius limit.

4. A method of stopping a mailbox door from opening beyond a swing opening radius limit, comprising the steps of:

providing a mailbox having at least one open end with a front edge, and lower hanging side edges which extend beneath a floor of the mailbox;

pivotally attaching the door to the open end of the mailbox; and attaching a bracket having bent ends to the lower hanging side edges of the mailbox so that the bracket adjacent to and behind the front edge of the mailbox;

preventing the mailbox door from opening beyond the swing opening radius limit, by a portion of the lower edge of the door abutting against a portion of the bracket; and cushioning an impact between the door and the mailbox with a pad positioned between the door and the bracket, when the door reaches the swing opening radius limit.

5. A mailbox for receiving mail, comprising:

a chamber having at least one open end with a front edge and lower hanging side edges which extend beneath a floor of the chamber;

a door pivotally attached to the open end of the chamber;

a bracket having a bumper portion attached to at least one of the lower hanging side edges of the open end of the chamber, so that the bracket is adjacent to and behind the front edge of the chamber, wherein the bracket provides for limiting a swing opening radius of the door by a portion of the lower edge of the door abutting against a portion of the bracket; and a cushion positioned between the door and the bracket for cushioning impact between the door and the bumper portion when the door reaches a swing opening radius limit.

6. A mailbox for receiving mail, comprising:

a chamber having at least one open end with a front edge, and lower hanging side edges which extend beneath a floor of the chamber;

a door pivotally attached to the open end of the chamber; and a bracket having an elongated midportion and opposing ends, the opposing ends being attached by fasteners to the lower hanging side edges such that the bracket is adjacent to and behind the front edge of the open end of the chamber, wherein the bracket provides for limiting a swing opening radius of the door by a portion of the lower edge of the door abutting against a portion of the bracket.

7. The mailbox of claim 6, further comprising:

a cushion positioned between the bracket and the door for cushioning impact between the door and the bracket when the door reaches the swing opening radius limit.

8. A mailbox for receiving mail, comprising:

a chamber having at least one open end with a front edge, and lower hanging side edges which extend beneath a floor of the chamber;

a door pivotally attached to the open end of the chamber; and an elongated member having opposing ends, the opposing ends being connected to the lower hanging side edges such that the elongated member is adjacent to and behind the front edge of the open end of the chamber, wherein the elongated member provides for limiting a swing opening radius of the door by a portion of the lower edge of the door abutting against a portion of the elongated member.

9. The mailbox of claim 8, further comprising:

a cushion positioned between the elongated member and the door for cushioning impact between the door and the elongated member when the door reaches the swing opening radius limit.

10. A mailbox for receiving mail, comprising:

a chamber having at least one open end with a front edge, and lower hanging side edges which extend beneath a floor of the chamber;

a door pivotally attached to the open end of the chamber; and a tab connected to at least one of the lower hanging side edges such that the tab is adjacent and behind the front edge of the open end of the chamber, wherein the tab provides for limiting a swing opening radius of the door by a portion of the lower edge of the door abutting against a portion of the tab.

11. The mailbox of claim 10, further comprising:

a cushion positioned between the tab and door for cushioning impact between the door and the tab when the door reaches the swing opening radius limit.

* * * * *

UNITED STATES PATENT AND TRADEMARK OFFICE

CERTIFICATE OF CORRECTION

PATENT NO. : 7,252,221 B1
APPLICATION NO. : 11/241616
DATED : August 7, 2007
INVENTOR(S) : John M. Bowers and Craig W. Walker It is certified that error appears in the above-identified patent and that said Letters Patent is hereby corrected as shown below:

On The Title Page

Item (12) should be changed to read:

Bowers, et al.

On The Title Page

Item (75) Inventors should be changed to read:

John M. Bowers, Orlando, FL (US)
Craig W. Walker, Rio Rancho, NM (US)

Signed and Sealed this

First Day of January, 2008

JON W. DUDAS
*Director of the United States Patent and Trademark Office*